US006477959B1

(12) United States Patent
Ritman et al.

(10) Patent No.: US 6,477,959 B1
(45) Date of Patent: Nov. 12, 2002

(54) WALL BREACHING WARHEAD

(75) Inventors: Zeev Ritman, Haifa; Mordechai Avitan, Kiryat Mozkin, both of (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/699,439

(22) Filed: Oct. 31, 2000

(30) Foreign Application Priority Data

Feb. 25, 2000 (IL) ..... 134735

(51) Int. Cl.[7] ..... F42B 12/10; F42B 12/22

(52) U.S. Cl. ..... 102/476; 102/306; 102/493

(58) Field of Search ..... 102/305–310, 102/473, 475, 476, 491–493; 89/1.14

(56) References Cited

U.S. PATENT DOCUMENTS

| | | | | | |
|---|---|---|---|---|---|
| 2,407,093 | A | * | 9/1946 | Mohaupt | 102/307 |
| 2,757,611 | A | * | 8/1956 | Church et al. | 102/307 |
| 3,129,665 | A | * | 4/1964 | Evans, Jr. | 102/476 |
| 3,477,372 | A | * | 11/1969 | McFerrin et al. | 102/307 |
| 3,623,432 | A | * | 11/1971 | Schminke | 102/476 |
| 5,275,355 | A | * | 1/1994 | Grosswendt et al. | 102/476 |

FOREIGN PATENT DOCUMENTS

| | | | | |
|---|---|---|---|---|
| DE | 4132662 | * | 4/1993 | 102/476 |
| FR | 1531538 | * | 7/1968 | 102/476 |
| GB | 1051407 | * | 12/1966 | 102/476 |
| RU | 1627806 | * | 2/1991 | 102/306 |

* cited by examiner

*Primary Examiner*—Harold J. Tudor

(57) ABSTRACT

A wall breaching warhead 10 for forming a hole through a brick wall includes a shaped charge 12 of explosive material having a central axis 14. The front surface of shaped charge 12 includes a central portion 16, adjacent to central axis 14, having a generally convexly-curved shape, and an annular portion 18, circumscribing central portion 16, having a generally concavely-curved shape. A metallic liner 20, adjacent to at least annular portion 18 of the front surface of charge 12.

10 Claims, 3 Drawing Sheets

WALL BREACHING WARHEAD

FIELD AND BACKGROUND OF THE INVENTION

The present invention relates to warheads and, in particular, it concerns a wall breaching warhead for making a hole of diameter sufficient to allow passage of personnel through a wall.

During military operation in urban terrain (MOUT), the ability to break quickly into buildings with minimum risk to the operating force is an obvious advantage.

Breaching of walls, particularly walls made from bricks, slabs or blocks (referred to generically herein as "brick walls") presents significant difficulties. Specifically, the shock waves of a blast tend to be transmitted through the front layer(s) of a brick wall, causing disintegration of the rearmost layer without causing significant damage to the front layer. As a result, a conventional blast warhead is typically only effective if a very large warhead is used, in the order of 10–20 kg of explosive, located against the wall. Such a large charge constitutes a hazard to the operating force and may cause excessive unwanted damage to personnel and property in the vicinity.

Other known techniques include attachment of a frame of a linear shaped charge to the wall to cut it, or use of an explosive annular shaped charge mounted in a pre-drilled hole to produce a larger hole. Both of these options requires manual extensive preparation adjacent to the wall, which is slow and, in many cases, exposes the operating force to unacceptable risk.

A further possibility is the use of a flexible squashed charge, which is shot dynamically towards the wall. Squashing of the explosive increases the contact area between the explosive and the wall, thereby enhancing the efficiency of delivering explosive energy to the wall. However, since it is detonated on the wall, only a relatively small hole is created.

None of the above techniques provides a warhead which is light enough to be shot dynamically from a remote position, which is effective to produce a man size hole in a brick wall, and which does not cause excessive damage to surrounding personnel and property.

There is therefore a need for a lightweight warhead which would be effective to breach brick walls.

SUMMARY OF THE INVENTION

The present invention is a wall breaching warhead for forming a hole through a brick wall.

According to the teachings of the present invention there is provided, a wall breaching warhead for forming a hole through a brick wall, the warhead comprising: (a) a shaped charge of explosive material having a central axis, the charge having a front surface including: (i) a central portion adjacent to the central axis having a generally convexly-curved shape, and (ii) an annular portion circumscribing the central portion, the annular portion having a generally concavely-curved shape; and (b) a metallic liner adjacent to at least the annular portion of the front surface.

According to a further feature of the present invention, the concavely-curved shape exhibits a concave profile as viewed in a cross-section through the shaped charge passing through the central axis, at least a major part of the concave profile being configured such that a vector projecting outward from, and perpendicular to, the front surface diverges from the axis.

According to a further feature of the present invention, the shaped charge has a length measured parallel to the central axis and an outer diameter measured perpendicular thereto, the outer diameter being about twice the length.

According to a further feature of the present invention, the shaped charge includes between about ½ kg and about 3 kg of explosive material Most preferably, the shaped charge includes less than about 2 kg of explosive material.

According to a further feature of the present invention, the metallic liner covers substantially the entirety of the front surface.

According to a further feature of the present invention, there is also provided a stand off detonation system including means for defining a stand off detonation distance of the shaped charge from the wall. Preferably, the means for defining a stand off detonation distance includes a stand off rod projecting from the front surface substantially parallel to the central axis.

According to a further feature of the present invention, the shaped charge has a rear surface, the warhead further comprising a rear cover associated with at least the rear surface, the rear cover being formed from non-penetrating material.

According to a further feature of the present invention, the annular portion corresponds to at least about half of the total area of the front surface as viewed parallel to the central axis.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a wall breaching warhead for forming a hole through a brick wall.

The principles and operation of warheads according to the present invention may be better understood with reference to the drawings and the accompanying description.

Figure 1:
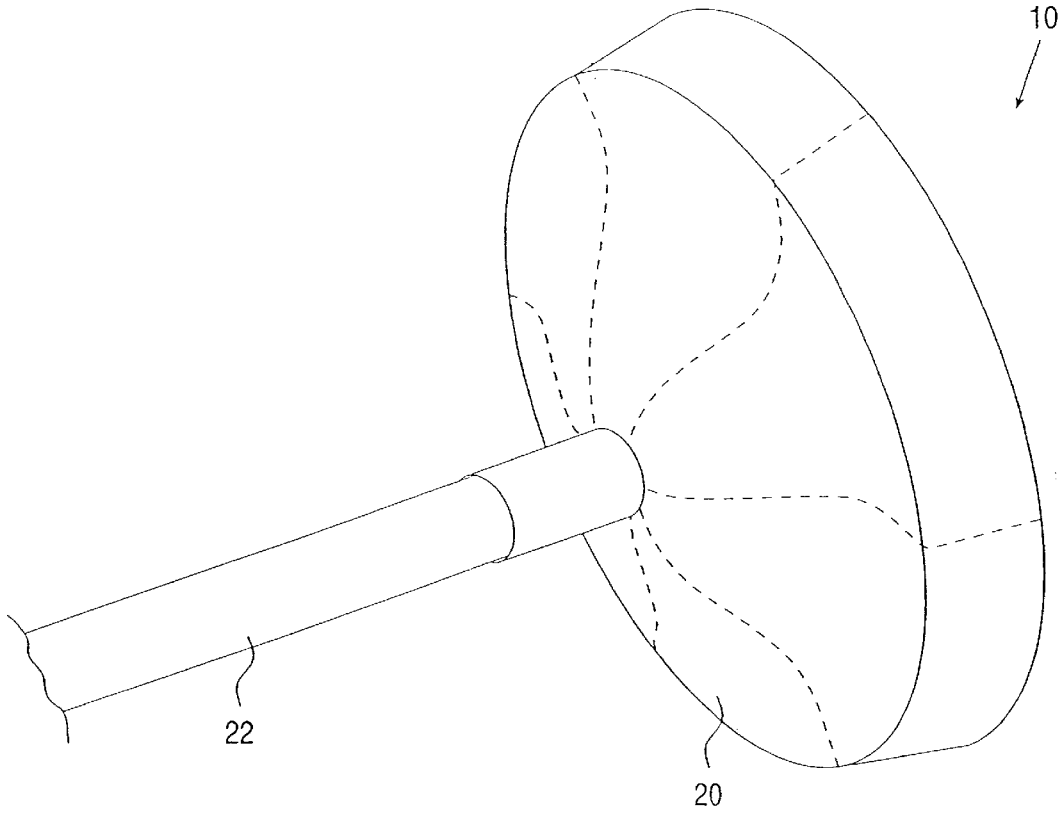
FIG. 1 is an isometric view of a wall breaching warhead, constructed and operative according to the teachings of the present invention, for forming a hole through a brick wall.
Figure 2:
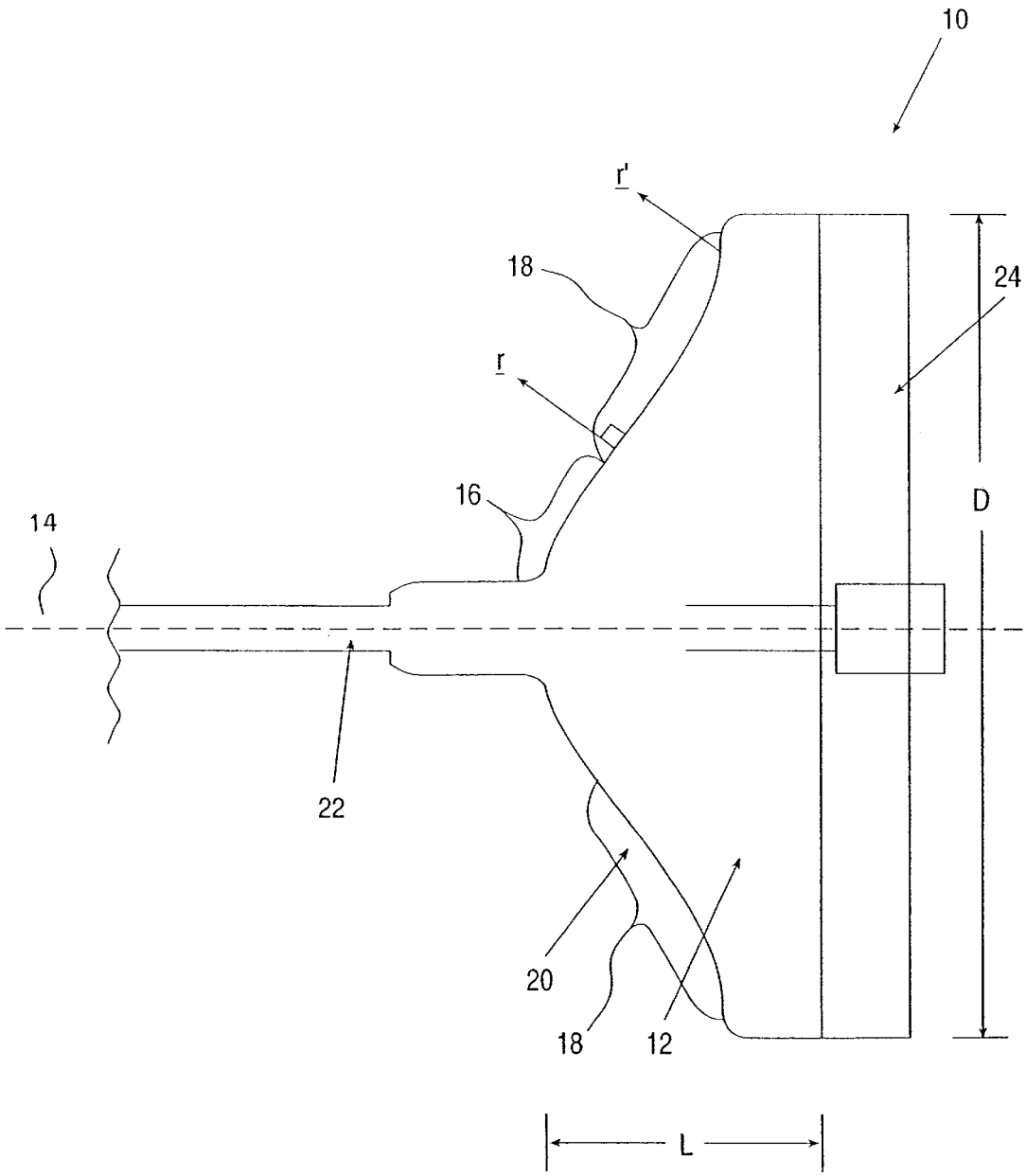
FIG. 2 is a cross-sectional view taken through the axis of the warhead of FIG. 1.
Figure 3:
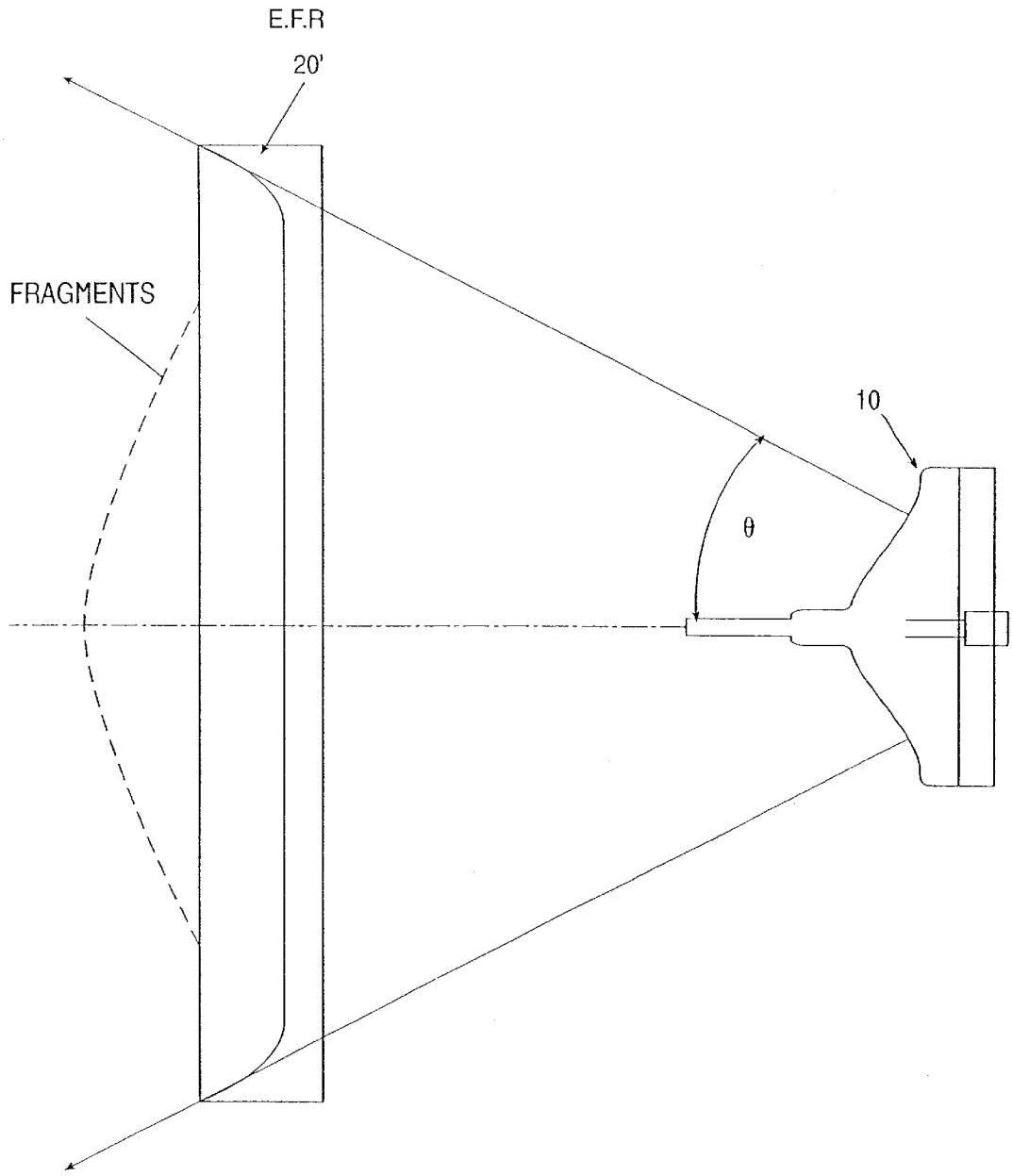
FIG. 3 is a schematic representation of the operation of the warhead of FIG. 1.

Referring now to the drawings, FIGS. 1–3 show a wall breaching warhead, generally designated 10, for forming a hole through a brick wall. Generally speaking, warhead 10 includes a shaped charge 12 of explosive material having a central axis 14. The front surface of shaped charge 12 includes a central portion 16, adjacent to central axis 14, having a generally convexly-curved shape, and an annular portion 18, circumscribing central portion 16, having a generally concavely-curved shape. A metallic liner 20, adjacent to at least annular portion 18 of the front surface of charge 12.

The operation of warhead 10 will be understood with reference to FIG. 3. The effect of concavely-curved annular portion 18 is to substantially concentrate a major part of the material from metallic liner 20 into an expanding conical path. In preferred cases, the material largely conglomerates into an expanding explosively formed ring ("EFR"), represented schematically by ring 20', which advances at a speed of roughly 2000 m/s, cutting a hole through the front layers of the wall. In addition, convexly-curved central portion 16 produces a spherical blast wave that breaks the rear wall layers by a scabbing effect. The combination of these two effects provides a very effective tool for breaching brick walls. The arrival of the blast wave together with the EFR also assists in knocking out the weakened front layer.

Before turning to features of the present invention in more detail, it should be appreciated that the invention is useful for breaching a wide variety of types of walls in different circumstances. Although not limited thereto, the invention is believed to be of particular value for breaching brick walls. In this context, it should be noted that the term "brick wall" is used herein in the description and claims to refer generically to any wall constructed of one or more layer of relatively small units piled in overlapping formation. The term is used irrespective of the particular material used for the units, whether it is "brick", stone, or slabs or blocks of any other construction material. The term is also used to include composite walls in which one or more layer of a brick-like formation is used together with other structural or insulation elements.

Turning now to the features of warhead 10 in more detail, concavely-curved annular portion 18 exhibits a concave profile as viewed in FIG. 2 (a cross-section through shaped charge 12 passing through central axis 14. Preferably, at least a major part of this concave profile is configured such that a vector v, v' projecting outward from, and perpendicular to, the front surface diverges from axis 14. Optionally, although not shown here, other parts of the profile may be angled so as to provide vectors parallel to, or even angled slightly towards, axis 14. These converging vectors, approximating closely to the direction of the explosive thrust experienced by the different parts of the liner, lead to focusing of the liner into a concentrated ring where they at least partially conglomerate to form the expanding EFR. The ring may break into fragments as it expands. However, the fragments are still generally sufficiently close together to provide a continuous cut through the wall.

It will be noted that the explosive thrust experienced by the liner is also influenced by the geometry of the point of initiation relative to the shaped surfaces. In the preferred example shown here, shaped charge 12 is made relatively flat. In more quantitative terms, an outer diameter D of shaped charge 12 measured perpendicular to axis 14 is preferably about twice the maximum length L of shaped charge measured parallel to axis 14. The use of point initiation in the middle of the back surface of shaped charge 12 tends to increase the conical angle (i.e., angle of divergence) of the EFR.

The various physical properties influencing the formation and properties of the EFR, including the shape of the charge, the point of detonation, the material and thickness distribution of the liner, and the type and amount of explosive used, are preferable chosen to impart a velocity to parts of the metallic liner of between about 1000 and about 4000 m/s, and most preferably, of about 2000 m/s. The expanding conical path of the EFR preferably has an angle θ relative to the axis of between about 30° and about 60°, and most preferably between about 40° and about 55° (see FIG. 3, below). Fine adjustment of the relative velocities of different parts of the liner may be used to shape the cross-sectional profile of the resulting EFR, varying from a round cross-section through a V-shaped cross-section (as seen in FIG. 3) to a flat band.

In order to allow spreading of the EFR to cut a hole of the desired diameter, shaped charge 12 should be detonated at a predefined distance from the surface of the wall to be breached. To this end, certain preferred implementations of warhead 10 include a stand off rod 22 projecting from the front surface substantially parallel to central axis 14. Stand off rod 22 is configured to define a stand off detonation distance of shaped charge 12 from the wall, as is known in the art. For a typical double brick wall, a standoff rod of length about 0.5 m has been found particularly effective. For a triple brick wall, a shorter rod, for example about 0.2 m, is typically preferred. Clearly, alternative implementations may achieve a similar effect using other techniques for detonating the charge at a predefined distance. Possible examples include, but are-not limited to, systems employing optical or electromagnetic sensors.

It should be appreciated that the combination of the cutting effect of the EFR together with the blast effect of the central portion of the shaped charge provides a highly efficient breaching effect. Thus, in striking contrast to quantities of 10–20 kg which would be required if a conventional blast charge were used, the shaped charge of the present invention preferably includes between about ½ kg and about 3 kg of explosive material, and most preferably less than about 2 kg. In tests, a single charge of about 1 kg of explosive has been found effective to breach a hole of about 1 m diameter in a double brick wall. For a triple brick wall, two or three such charges are required. This charge is light enough to be carried by a rocket or missile designed for carrying only a few kg of explosive, thereby avoiding the need to send the operating force to the wall.

As mentioned before, metallic liner 20 is adjacent to at least annular portion 18 of the front surface of charge 12. This preferably corresponds to at least about half of the total area of the front surface as viewed parallel to central axis 14. In practice, it is usually preferred to form metallic liner 20 as a continuous layer covering substantially the entirety of the front surface and, in the example illustrated, also the peripheral edge of shaped charge 12. The central region of liner 20 overlying convex region 16 then contributes additional fragments (see FIG. 3) which supplement the effect of the blast wave for removing the cut-out part of the wall. The rear surface of shaped charge 12 is preferably covered by a rear cover 24 formed from non-penetrating material. In this context, "non-penetrating" is used to refer to materials which do not generally form high speed fragments with high penetration. Examples include, but are not limited to, plastics and composite materials. The use of a rear cover made from non-penetrating material reduces the likelihood of rearward-flying fragments which could pose a danger to the operating force.

It will be appreciated that the above descriptions are intended only to serve as examples, and that many other embodiments are possible within the spirit and the scope of the present invention.

What is claimed is:

1. A wall breaching warhead for forming a hole through a brick wall, the warhead comprising:

(a) a shaped charge of explosive material having a central axis, said charge having a front surface including:

(i) a central portion adjacent to said central axis having a generally convexly-curved shape, and (ii) an annular portion circumscribing said central portion, said annular portion having a generally concavely-curved shape; and (b) a metallic liner adjacent to at least said annular portion of said front surface, wherein said annular portion and said metallic liner are configured such that, on detonation of said charge, a major part of the material from said metallic liner is concentrated into an expanding conical path diverging from said central axis at an angle of between 30° and 60°.

2. The warhead of claim 1, wherein said concavely-curved shape exhibits a concave profile as viewed in a cross-section through said shaped charge passing through said central axis, at least a major part of said concave profile being configured such that a vector projecting outward from, and perpendicular to, said front surface diverges from said axis.

3. The warhead of claim 1, wherein said shaped charge has a length measured parallel to said central axis and an outer diameter measured perpendicular thereto, said outer diameter being about twice said length.

4. The warhead of claim 1, wherein said shaped charge includes between about ½ kg and about 3 kg of explosive material.

5. The warhead of claim 1, wherein said shaped charge includes less than about 2 kg of explosive material.

6. The warhead of claim 1, wherein said metallic liner covers substantially the entirety of said front surface.

7. The warhead of claim 1, further comprising a stand off detonation system including means for defining a stand off detonation distance of said shaped charge from the wall.

8. The warhead of claim 7, wherein said means for defining a stand off detonation distance includes a stand off rod projecting from said front surface substantially parallel to said central axis.

9. The warhead of claim 1, wherein said shaped charge has a rear surface, the warhead further comprising a rear cover associated with at least said rear surface, said rear cover being formed from non-penetrating material.

10. The warhead of claim 1, wherein said annular portion corresponds to at least about half of the total area of said front surface as viewed parallel to said central axis.

* * * * *